United States Patent [19]

Bailey et al.

[11] Patent Number: 4,700,687

[45] Date of Patent: Oct. 20, 1987

[54] PREFABRICATED CONVERTIBLE FIREPLACE

[75] Inventors: Robert L. Bailey; Kenneth L. Howell, both of Spruce Pine, N.C.

[73] Assignee: Minpro Supply, Incorporated, Spruce Pine, N.C.

[21] Appl. No.: 895,272

[22] Filed: Aug. 11, 1986

[51] Int. Cl.[4] ..... F24B 7/00

[52] U.S. Cl. ..... 126/121; 126/126; 126/139; 126/142; 237/51

[58] Field of Search ..... 126/120, 121, 126, 131, 126/286, 288, 312, 139, 142, 307 R; 237/51

[56] References Cited

U.S. PATENT DOCUMENTS

| | | | |
|---|---|---|---|
| 3,190,279 | 6/1965 | Davis | 126/120 |
| 3,880,139 | 4/1975 | Young | 126/126 |
| 4,117,827 | 10/1978 | Billmeyer | 126/121 |
| 4,179,065 | 12/1979 | Zung | 126/121 |
| 4,271,815 | 6/1981 | Johnson | 126/121 |
| 4,475,531 | 10/1984 | Gerhart | 126/121 |

*Primary Examiner*—James C. Yeung

*Attorney, Agent, or Firm*—Charles R. Rhodes; Judith E. Garmen

[57] ABSTRACT

A prefabricated fireplace structure is convertible to function as an open fireplace or an enclosed, solid fuel burning stove. An outer fireproof cabinet for installation in existing building framing or new construction, receives a selected compatible firebox in the form of a log-burning fireplace or a substantially enclosed wood/coal-burning stove. The selected firebox includes a damper and an exhaust outlet therein, which exhaust outlet is connected to a flue pipe in the outer cabinet. A unique connecting device secures the selected firebox in the cabinet and further includes a means for sealing the connection of the exhaust outlet to the flue pipe inlet.

10 Claims, 5 Drawing Figures

PREFABRICATED CONVERTIBLE FIREPLACE

BACKGROUND OF THE SUMMARY OF THE INVENTION

The use of prefabricated fireplace systems has increased significantly in new construction and also in existing construction where a fireplace was not originally provided. Most prefabricated fireplaces are comprised of concrete and insulated metal structures that are installed in original building construction, or alternatively are freestanding metal shells which are installed in various locations including the corner of an existing room. Known prefab units which are conventionally installed at the time of building construction generally include a metal insulating liner and a built-in, non-removable firebox; the firebox being the actual combustion or fuel-burning chamber. Once the prefab fireplace (usually an open, log burning type) is installed, the unit is essentially permanent. Any attempt to change the type or style of firebox is virtually impossible without a major restructuring or renovation.

Freestanding fireplaces which stand outside the wall in a given area of a room offer slightly more flexibility and can be removed and exchanged for a closed, solid fuel stove. But with these freestanding fireplaces there is no way to obtain the look of a conventional built-in fireplace.

With the advent of improved solid fuel-burning stoves and a trend toward use of these stoves to replace or supplement central heating systems, it has been increasingly desirable to be able to convert a fireplace from an open unit (firebox) to a closed unit, or vice versa. With any built-in fireplace, such modifications are either impossible or quite expensive and not easily accomplished. With some known prefab units, it has been possible to install a wood-burning stove in the fireplace, but no known installations such as this are safety tested and listed by Underwriters Laboratories. Therefore, insurance companies and local building codes are frequently rejecting any prefabricated fireplace modifications which include a fireplace insert. Most prefab fireplaces are too small to receive the stove therein, and since they are an integral part of the prefabricated unit, there is no reasonable way to remove integral parts without damaging the safety components of the whole structure.

It was therefore an objective of the present inventor to develop a prefabricated fireplace unit that could be installed in new or existing construction and which, after installation, could be convertible as desired from an open fireplace to an enclosed stove or vice versa. The present invention accomplishes these and other objectives and is comprised of an insulating cabinet which is installed in the existing or new building framework and which is designed to selectively receive an open or closed firebox. The preferred fireboxes include an open fireplace (for wood or gas logs) and an enclosed solid fuel (wood or coal) burning stove. An exhaust outlet in the outer insulating cabinet is connected to a chimney and to the firebox for exhausting combustion fumes from the building. The fireboxes include damper plates and exhaust outlets which are connected to the corresponding exhaust outlet in the insulating cabinet by an adapter conduit. The firebox exhaust outlet further includes a unique clamping or latching means associated therewith which removably connects the adapter conduit into sealed communication with the exhaust outlet conduit of the insulating cabinet. When it is desired to change fireboxes, the connecting mechanism is disengaged, the adapter conduit lifted, and the firebox is removed from the insulating cabinet and replaced with another. A trim package comprised of a covering frame surrounds the front edges of the top, bottom and side walls of the cabinet housing and abuts the side and top walls of the firebox to conceal the unfinished exposed edges of the two units and make a more attractive assembly.

The preferred enclosed firebox or stove is a wood or coal burning stove constructed in a size to fit within the outer insulating cabinet and designed such that the doors to the stove open into the room from the front.

An optional attached fan mounted between the firebox and the cabinet housing circulates the heated air around the walls of the firebox and back into the room environment.

The specific construction design and installation is detailed below and will be more easily understood when studied in conjunction with the accompanying drawings. In the drawings:

FIG. 4 is an exploded perspective view of the locking assembly; an

DETAILED DESCRIPTION OF A PREFERRED EMBODIMENT

Figure 1:
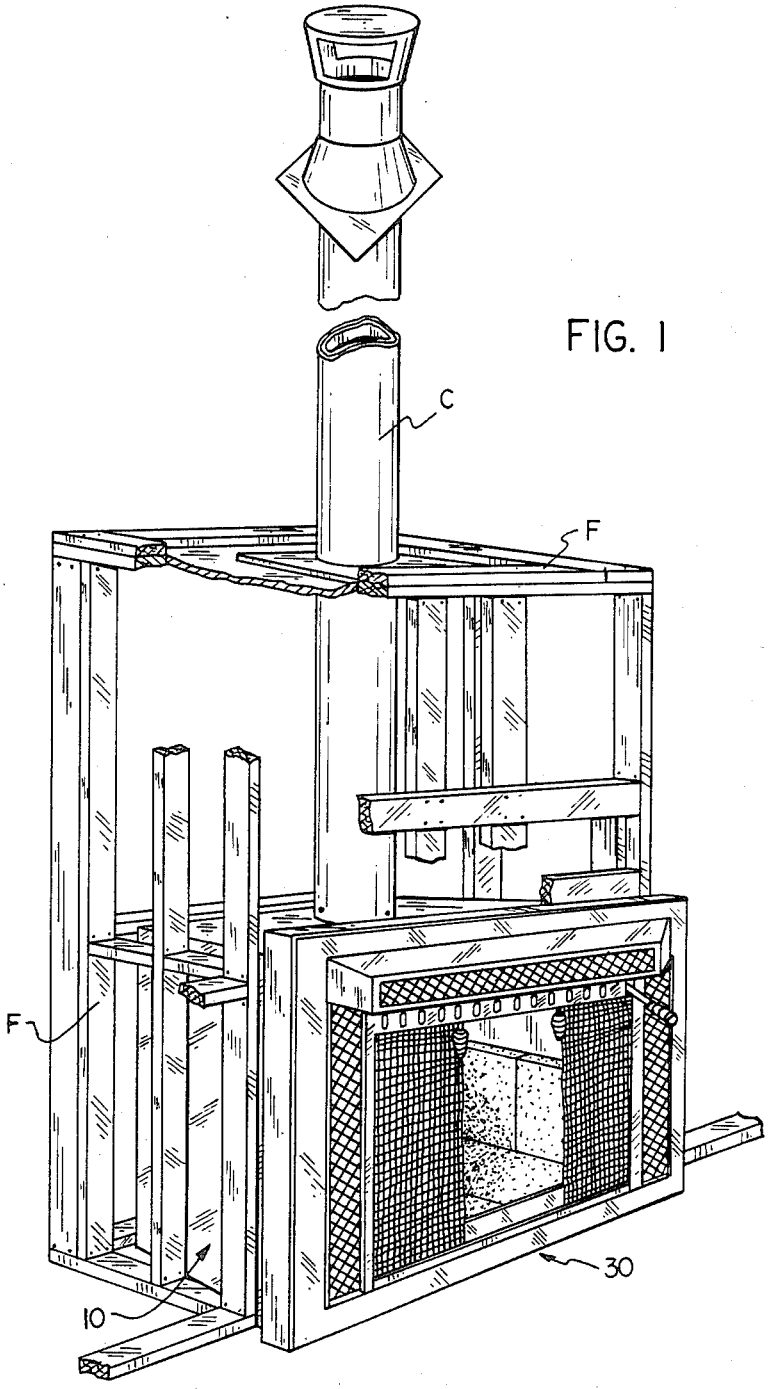
FIG. 1 is a perspective view of the prefabricated fireplace, with parts broken away, wherein the selected firebox is a open fireplace.
Figure 2:
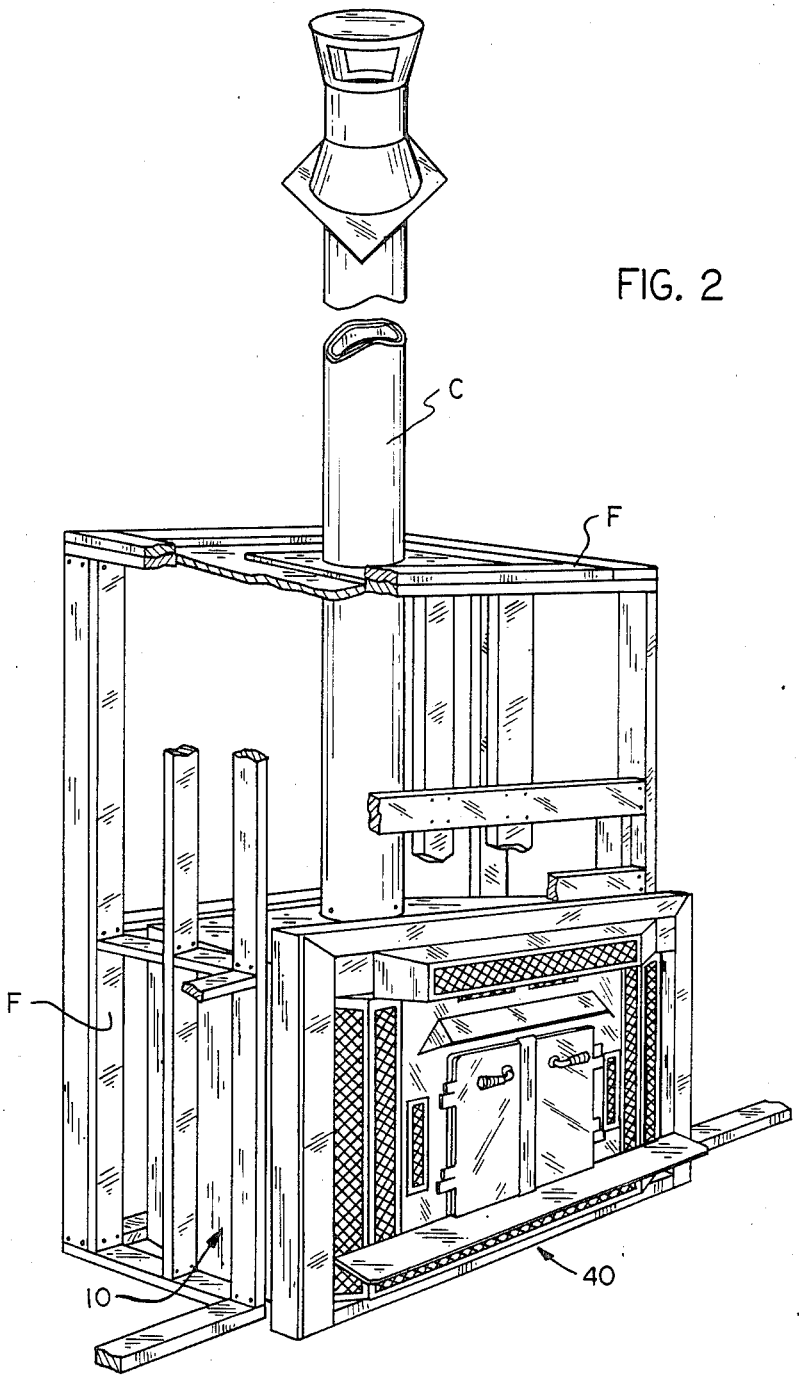
FIG. 2 is a perspective view of the prefabricated fireplace, with parts broken away, wherein the selected firebox is an enclosed, solid fuel-burning stove.
Figure 3:
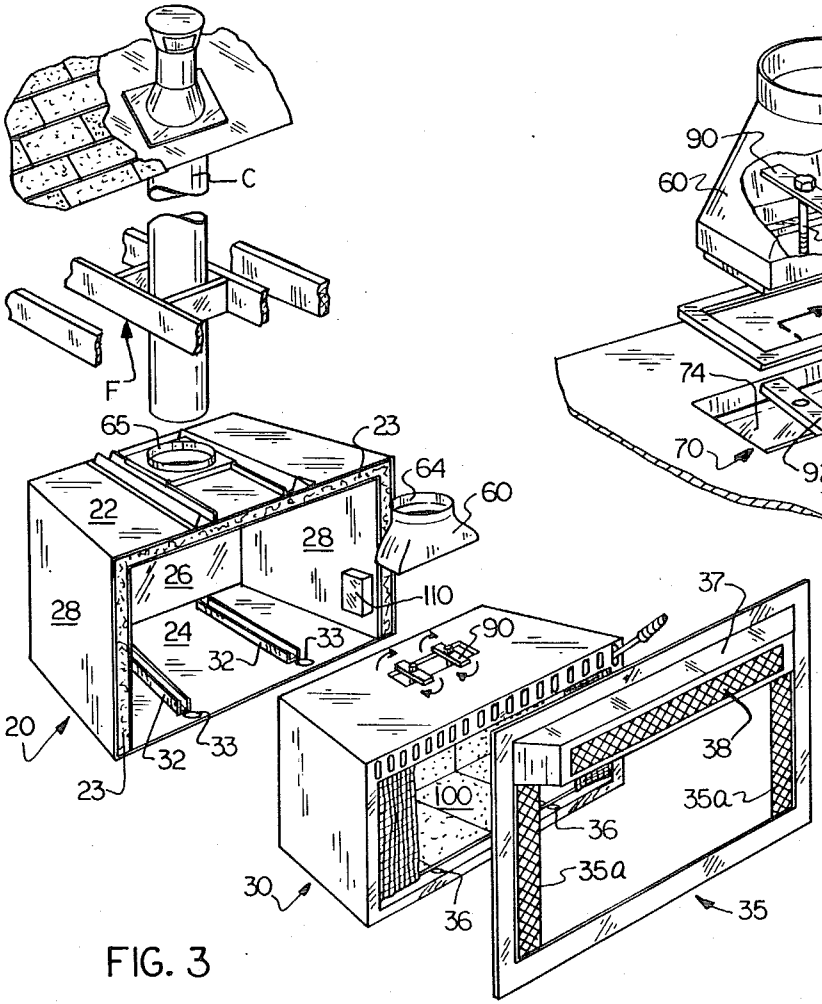
FIG. 3 is an exploded perspective illustrating the basic assembly that is installed into the building construction.

Looking first at FIGS. 1 and 2, the installation and building framework around the insulating cabinet liner is identical for both the open and closed fireboxes. Modifications for use of the open fireplace or the closed stove are made to the firebox and insulating cabinet housing and not to the surrounding framework. Construction framing for the prefabricated fireplace, as stated above, may be the original building framing or it may be an addition to a corner of an existing room or to a closet that is framed in to receive and enclose the prefabricated fireplace unit. FIGS. 1 and 2 both illustrate wood studding around the insulating housing and chimney, but a masonry surface might be added around the studding and/or in front of the exterior face wall to give the appearance of a conventional masonry fireplace. The chimney and exhaust conduits are standard assembly and are not a claimed element of the present invention. Therefore, because any of several known chimney units might be utilized, the chimney is not described in detail. FIG. 3 more clearly illustrates the assembly of the insulating cabinet or firebox housing to the conventional chimney.

FIGS. 1 and 2 detail the construction and framing F that surrounds the prefabricated fireplace unit 10, and the chimney C which exhausts combustion fumes to the exterior of the building. A removable trim frame around the face thereof finishes the appearance and conceals the exterior unfinished surfaces of the insulating housing and the firebox.

FIG. 3 illustrates the relationship of the component parts of the prefabricated fireplace unit 10. A double walled outer housing or insulating cabinet 20 has dual top walls 22, bottom walls 24, rear walls 26 and side walls 28 and is installed in the framework F as shown in FIGS. 1 and 2. Insulation material 23 is sandwiched between the dual inner and outer walls for improving the safety of the surrounding flammable structure.

The front of the housing 20 is open to receive the selected firebox in the form of an open front fireplace 30 or a closed, solid fuel burning stove 40. The selected firebox 30 or 40, as a unit, is installed in the insulating cabinet 20, raised slightly from the floor 24 by a pair of track members 32 which not only support the firebox 30 or 40 but help guide the firebox into position in the cabinet 20. In the fireplace 30 the forward portion of the floor 34 of the open firebox 30 includes a means for attaching the front of the firebox to the floor of cabinet 20. The preferred means is comprised of screws 36 which extend through the floor of the firebox 30 into threaded apertures 33 in the channels 32 of the cabinet 20.

Figure 4:
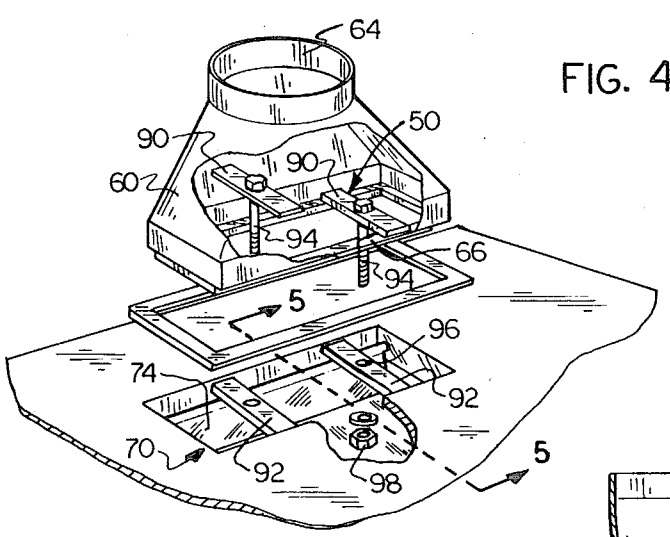
Figure 5:
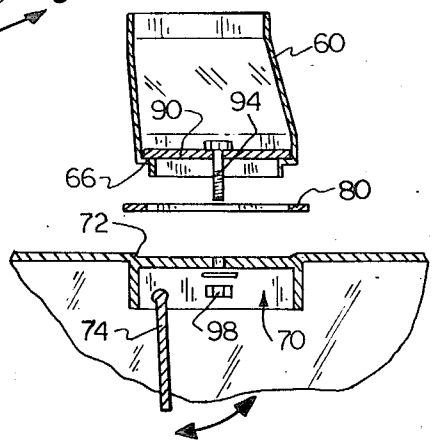
FIG. 5 is a cross-sectional view taken along lines 5—5 of FIG. 4.

A further means for removably securing the selected firebox 30 or 40 into cabinet 20 is associated with the damper and exhaust area and is illustrated in detail in FIGS. 4 and 5. However, before moving to that description, attention is called to trim frame 35 which is placed over the front edges of the cabinet 20 and abuts the side and top walls of firebox 30 or 40 to conceal the unfinished surfaces thereof. The trim frame 35 gives a finished appearance to the front of the fireplace. A pair of adjustable side grates 35*a* abut the firebox when inserted, and slide laterally within trim frame 35 to permit easier removal of the firebox, then are easily returned to their abutting position when the firebox is emplaced. The upper portion of the frame includes a cornice member 37 which has an open mesh or wire grate 38 through which warm air is circulated during use of the fireplace. In preferred embodiments the grate 38 is removable to provide access into the damper area of the firebox and thus to the connecting means 50 which secures the firebox in the outer insulating cabinet 20. The trim frame 35 is attached in place over the edges of the cabinet by means of screws or other removable attachment means (not shown).

Looking next at FIGS. 4 and 5, the connecting means 50 for attaching the firebox 30 or 40 to the cabinet 20 is shown in detail. Broadly described, the connecting means 50 comprises a clamping device that is operatively engaged between a horizontal shoulder on the lower end of the flue pipe 60 which connects the chimney C to the exhaust outlet 70 of the selected firebox. A gasket 80 positioned between the confronting edges of the underside of shoulder 66 of the flue pipe and the edges 72 of the exhaust outlet seals the juncture and prevents escape of combustion fumes.

Looking first at the conduit connection between the cabinet 20 and the chimney, a flue stack 60 is dependingly mounted on and underneath top wall 22 of the cabinet and includes an upper annular portion 64 which attaches to the chimney connector 65 on the upper, outer side of top wall 22. The annular portion or collar 64 is slidably associated with chimney connector 65, whereby collar 64 slips around the lower edge of connector 65. The sliding adjustment is necessary to allow the stack 60 to be pushed away or pulled into place in the exhaust opening 70. Inside the stack 60 is a horizontal shoulder 66 and depending flange 67 which extends around the inner walls of the stack, the shoulder 66 being perpendicular to the stack walls and parallel to the upper wall 22 of the cabinet. Each of the fireboxes 30 and 40 includes the exhaust opening 70 in the top wall thereof. The opening has an underlying damper plate 74 that is movable between a first open position and a second closed position. The first, or open position is shown in FIGS. 4 and 5. In the closed position plate 74 extends across opening 70, parallel to wall 22.

The clamping means is mounted within the opening 70 for connection of the flue stack to the damper opening. The clamping means is comprised of a pair of rotating latch plates 90 normally supported within the damper exhaust outlet. The latch plates 90 are supported and held in place by means of a pair of cross-bars 92 that extend across the damper exhaust outlet. The cross-bars are permanently mounted and are spaced apart such that there is one associated each end of the exhaust opening 70. The latch plates 90 are mounted on the cross-bars 92 by means of a support shaft 94 depending perpendicularly from the underside of the latch plate. Each support shaft 94 is movable in an aperture 96 in the approximate center of each cross-bar. The support shaft 94 is vertically movable and rotatable in the aperture 96. Thus mounted, each of the latch plates 90 is extendable from a normal first position on the cross-bar 92 in the exhaust outlet, to a second latching position whereby each latch plate 90 is pushed upwardly and slightly rotated to move into the opening of the flue stack and is then rotated into a position where the plates 90 engage opposite sides of the horizontal shoulder 66 within the flue stack. The latch plate support shaft 94 is retained in the aperture 96 by means of an internally threaded nut 98 that is compatible with the threaded end 94 of the support shaft. When the latch plate 90 is in position on the horizontal shoulder 66 as shown in FIGS. 4 and 5, the nuts 98 may be threaded upwardly on shafts 94 in the direction of plates 90. As the nuts 98 are thus tightened against the underside of cross bars 92, the flue stack, the gasket, and the exhaust opening are pulled tightly together.

The same construction of the flue, exhausts, and damper is found in either firebox 30 or 40. Such a construction provides a means for permitting the interchanging of the fireboxes, and thus permits the conversion of the fireplace from the open log burning type to the closed, solid fuel burning stove. As previously mentioned, the conversion may be made as frequently as desirable by merely unlocking the latch plates and retracting them back into the firebox exhaust opening; by pushing the flue pipe up and out of engagement with the exhaust outlet 70; and by removing the screws 36 in the forward portion of the firebox. Thus disconnected, the firebox is easily withdrawn from the insulating cabinet 20 and replaced with a new firebox.

The construction of the unit is of sheet metal material of the type conventionally used for stoves and metal fireplaces. The open firebox 30 includes a ceramic or refactory liner 100 in the floor and back and sides. An air space exists between the outer wall of the selected firebox and the inner walls of the insulating cabinet 20, providing further insulation. Additional insulation may be installed between the outer wall of cabinet 20 and building framing F as required by local building codes. A fan means 110 pulls room air into the unit and recirculates warmed air back into the room as is well known to do.

While a preferred embodiment of the invention has been described herein, it is understood that other and further modifications might become apparent to those skilled in the art. Such modifications may be made within the scope of the invention which is limited only by the scope of the claims below.

What is claimed is:

1. A prefabricated fireplace structure for installation within the wall structure of existing building framing or new construction, and convertible between a first configuration incorporating an open fireplace and a second configuration incorporating an enclosed stove; said fireplace structure comprising:

(a) an insulating cabinet fixed within said wall structure for receiving and housing a selected one of a plurality of types of compatible fireboxes; said insulating cabinet having insulated top, bottom, side and rear walls, an open front, and a plurality of support members secured to said bottom wall and extending from front to rear on which said selected firebox rests;

(b) conduit means associated with one of said insulating cabinet walls for connecting said insulating cabinet to an associated chimney for exhausting combustion gases to the outside of the building; and (c) a firebox completely separable as a unit and slidably resting on said support members in said insulating cabinet, said firebox including an exhaust outlet in opposed relationship to said conduit means; and a connecting means for releasably connecting the exhaust outlet of said firebox to the conduit means interiorly of said insulating cabinet, and a sealing means for substanially forming a releasale, sealed connection between said exhaust outlet and said conduit means.

2. A prefabricated fireplace structure accoring to claim 1 wherein said selected firebox is comprised of an open fireplace; said fireplace including:

(a) top, bottom, rear, and side walls and an open front.

3. A prefabricated fireplace structure according to claim 1 wherein said firebox is a stove of the type which is generally fueled by solid fuel and the combustion chamber is substantially closed from the room atmosphere by doors.

4. A prefabricated fireplace according to claim 1 and further including a trim frame for attachment around the walls of said firebox to conceal the exposed edges of said insulating cabinet, giving the appearance of a unitary construction.

5. A prefabricated fireplace structure according to claim 4 wherein said trim frame further includes a cornice member across the top thereof, said cornice having a removable grate member for providing access to said connecting means.

6. A prefabricated fireplace structure according to claim 1 wherein said conduit means is an adapter conduit which changes from a shape corresponding to the said exhaust opening to a shape corresponding to the lower end of the chimney.

7. A prefabricated fireplace structure according to claim wherein said connecting means comprises:

(a) said conduit means having an inwardly turned shoulder on the lower end thereof;

(b) a clamping device operatively engaged between said horizontal shoulder and firebox for retaining said shoulder in said exhaust outlet;

(c) means for adjusting said clamping device to pull said shoulder into said exhaust outlet; and (d) a gasket positioned between said shoulder of said conduit and the surface said wall surrounding said exhaust outlet to prevent escape of fumes through the juncture thereof.

8. A prefabricated fireplace according to claim 7 wherein said connecting means further includes a chimney connector in the wall of said housing and conduit means is slidably associated with said chimney connector so that said conduit means can be pushed up and out of or pulled into said exhaust outlet of said firebox.

9. A prefabricated fireplace structure according to claim 7 wherein said clamping device includes:

(a) said exhaust outlet being positioned in a selected wall of said firebox immediately above the damper plate of said firebox, such that said exhaust outlet is accessible from within said firebox when said damper plate is open;

(b) said exhaust outlet having a latch support bracket extending across the width thereof for retaining and supporting said latch;

(c) latch plate mounted on said bracket, said latch plate being mounted for rotation in a plane parallel to said horizontal shoulder on said exhaust inlet, and including means for vertically adjusting the position of said latch plate, such that said latch plate may be moved upwardly to a height sufficient to engage said shoulder; said latch being rotated into a position overlying opposing edges of said shoulder;

10. A prefabricated fireplace structure according to claim 8 wherein said means for tightening said latch in said latching position includes:

(a) said means for vertically adjusting the position of said plate being comprised of a vertical shaft depending from the underside of said latch plate;

(b) said bracket including an aperture therethrough and said shaft being vertically, movably engaged in said aperture;

(c) the end of said shaft opposite said latch plate being threaded to receive an internally threaded nut thereon; said nut being threaded upwardly against the underside of said bracket when said latch plate is engaged over said shoulder;

thereby pulling said shoulder into said exhaust outlet and sealing against leaking of combustion fumes.

* * * * *